US008118710B2

(12) United States Patent
Weinman et al.

(10) Patent No.: US 8,118,710 B2
(45) Date of Patent: Feb. 21, 2012

(54) EXERCISE MACHINE

(75) Inventors: Andrew Weinman, Mont-Tremblant (CA); Sylvain Morrissette, Sherbrooke (CA); Patrick Vincent, Sherbrooke (CA); Stelio Derventzis, Richmond Hill (CA)

(73) Assignee: Equator Fitness IP Holdings Inc., Mont-Tremblant, Quebec (CA)

( * ) Notice: Subject to any disclaimer, the term of this patent is extended or adjusted under 35 U.S.C. 154(b) by 0 days.

(21) Appl. No.: 12/937,743

(22) PCT Filed: Apr. 14, 2009

(86) PCT No.: PCT/CA2009/000463

§ 371 (c)(1), (2), (4) Date: Dec. 28, 2010

(87) PCT Pub. No.: WO2009/127043

PCT Pub. Date: Oct. 22, 2009

(65) Prior Publication Data

US 2011/0111922 A1 May 12, 2011

Related U.S. Application Data

(60) Provisional application No. 61/071,134, filed on Apr. 14, 2008.

(51) Int. Cl.
*A63B 71/00* (2006.01)

(52) U.S. Cl. ..... 482/2; 482/51; 482/52; 482/57

(58) Field of Classification Search ..... 482/1–9, 482/52, 57, 62, 65, 121, 900–902; 601/97, 601/98, 100, 107, 115, 116, 118, 122, 126
See application file for complete search history.

(56) References Cited

U.S. PATENT DOCUMENTS

| | | | | |
|---|---|---|---|---|
| 2,107,449 | A * | 2/1938 | Marlowe | 601/36 |
| 3,777,745 | A * | 12/1973 | Simjian | 601/115 |
| 3,945,637 | A * | 3/1976 | Simjian | 482/62 |
| 4,003,375 | A * | 1/1977 | Simjian | 601/107 |
| 4,534,553 | A * | 8/1985 | Shirley | 482/65 |
| 5,035,418 | A | 7/1991 | Harabayashi | |
| 5,215,511 | A * | 6/1993 | Cheng | 482/121 |
| 5,376,060 | A | 12/1994 | Murray | |
| 5,507,710 | A | 4/1996 | Chen | |

(Continued)

FOREIGN PATENT DOCUMENTS

WO WO 2008/024291 A2 2/2008

OTHER PUBLICATIONS

International Search Report (PCT/ISA/210) issued on Aug. 11, 2009, by Canadian Patent Office as the International Searching Authority for International Application No. PCT/CA2009/000463.

(Continued)

*Primary Examiner* — Glenn Richman
(74) *Attorney, Agent, or Firm* — Buchanan Ingersoll & Rooney PC

(57) ABSTRACT

An exercise machine provides a total body workout by exercising the legs, back, shoulders, obliques and abdominal muscles. The machine's backrest rolls is in phase with the movement of the legs, allowing the body to sit in a position that is comfortable and secure. The spinal column is continually supported during the workout. Pedal movement powers the machine's electronics and maintains the battery's charge.

16 Claims, 14 Drawing Sheets

U.S. PATENT DOCUMENTS

| | | | | |
|---|---|---|---|---|
| 5,580,340 | A | 12/1996 | Yu | |
| 5,609,566 | A | 3/1997 | Pupovic | |
| 5,833,582 | A | 11/1998 | Chen | |
| 5,897,459 | A | 4/1999 | Habing et al. | |
| 6,413,192 | B2 | 7/2002 | Abelbeck | |
| 6,547,702 | B1 * | 4/2003 | Heidecke | 482/62 |
| 6,832,991 | B1 * | 12/2004 | Inada et al. | 601/99 |
| 6,955,630 | B2 | 10/2005 | Sher | |
| 7,121,985 | B2 * | 10/2006 | Cheng | 482/57 |
| 7,195,583 | B2 * | 3/2007 | Leib | 482/52 |

OTHER PUBLICATIONS

Written Opinion (PCT/ISA/237) issued on Aug. 11, 2009, by Canadian Patent Office as the International Searching Authority for International Application No. PCT/CA2009/000463.

European Supplementary Search Report dated Jul. 27, 2011 issued in the corresponding European Patent Application No. 09733648.1-1260/2271411.

* cited by examiner

EXERCISE MACHINE

FIELD OF THE INVENTION

The present invention relates to an exercise machine, and more particularly to an exercise machine that provides a full body workout by exercising various muscle groups simultaneously, including both the lower and upper body of the user, contemplating the aspects of dynamic and geometric balance.

One objective of the invention is to provide an exercise machine that allows the simultaneous exercising of both the lower and upper body in a safe and continuous way. The exercise design concept borrows from the harmonic nature of walking, in which the movements of the legs and hip are naturally phased and proportioned, resulting in an all around fluid movement with continuous balance. The apparatus of the present invention further illustrates various exercise configurations options to achieve the user's different fitness goals.

BACKGROUND

The modern awareness of the importance of regular physical exercise has been driving a steady growth for the fitness industry. Given the pressures of modern lifestyle, people of all age groups are concerned with the amount of time required to achieve a reasonable level of fitness, thereby highlighting the need to provide workout programs, machines and accessories which allow the maximum physical workout to be achieved in the shortest amount of time. This focus on efficiency led to the development of multi featured exercise machines, now commonly found in health clubs, gymnasiums and households alike.

Proper ergonomic and stability considerations have evolved steadily over the past several years. Still, many of the exercise machines presently found in the market fail to address issues like adequate, continuous support to the user's body throughout the workout routine, and in some instances can lead to injuries due to the jerking, spasmodic nature of the user's movements as well as undue stress on several body joints. Proper consideration of these aspects is especially important for the following users: the elderly, pregnant women, those with some orthopedic condition and people who are not in shape, amongst others.

In the so called "dual action" or "total body" exercise machines the concept of harmonization of movements is important from the perspectives of ergonomics and comfort. Without sound consideration of the interplay between diverse body part movements, the resulting exercise may be perceived by the user as awkward and unpleasant. Worse still, in an effort to compensate for insufficient or non-continuous support by the machine itself, the user is typically forced to tense up other muscle groups in order to preserve his or her balance, yielding unnecessary extra muscular effort that is unintended and potentially harmful to the user. This problem is especially serious for novice users, whose tendency to attribute any discomfort during the exercise to their poor fitness condition might lead to serious injuries.

Many of the prior art dual action exercise machines lead the user to motions that compromise comfort, efficiency and in some circumstances safety. To overcome these limitations, the present invention provides an exercise machine designed around the concept of dynamic and geometric balance, mitigating the aforementioned problems.

SUMMARY OF THE INVENTION

The exercise machine according to the present invention comprises a rigid frame that supports the user and the various machine components. The user sits in a chair that has a seat fixed to the machine's rigid support frame, a slanted backrest and a headrest. The user's torso is positioned in the area proximate one end of the machine's support frame. The user's feet rest against pedals located at the opposite end of the machine's support frame. The machine's main mechanical and electronic systems lies in front of the foot pedals proximate the user's feet, in a covered box, which is fixed to the machine's support frame.

During the exercise routine the lower portion of the user's legs assumes an orientation that is approximately horizontal, and the user's feet contact a pair of pedals positioned about perpendicular to the legs. These pedals are positioned on either side of the box containing the mechanical and electronic systems. The movement of the pedals drives the movement of several elements contained in the box. A portion of the mechanical energy imparted to the machine by the user's pedaling movement is directed to drive a rolling movement of the chair's backrest, while another portion is used to power various electrical systems in the machine and also to maintain the charge of a battery.

Other aspects, advantages and novel features of the invention will become clearer from the following detailed description when taken in conjunction with the accompanying drawings. References made to the accompanying drawings form an integral part of the specification, and like reference numerals designate corresponding parts in the several views presented.

Use of the present invention has several advantages over the prior art. It allows the user to perform a full body, low-impact exercise routine in less time and with enhanced safety in view of the firm and continuous support offered during all phases of the movement. The continuous balance afforded by the machine reduces stress and allows the user to concentrate on the workout instead of spending time manoeuvring for balance. The adjustability of the load contemplates all levels, from out of shape beginners to advanced, high performance users. The machine allows the user to conduct an aerobic workout of the legs, back, shoulders, obliques and abdominal muscle groups, and optionally, the arms.

DETAILED DESCRIPTION OF THE INVENTION

The invention will now be described with reference to the figures. The figures are intended to be illustrative rather than limiting and are included herewith to facilitate the explanation of the invention.

For the sake of spatial reference, let us establish the definition of the machine's front and rear portions regarding its longitudinal axis. The machine's front portion is herein defined as the one nearest to the mechanical and electronic systems box (1). The machine's rear portion is herein defined as the one nearest to the user's chair.

Figure 1:
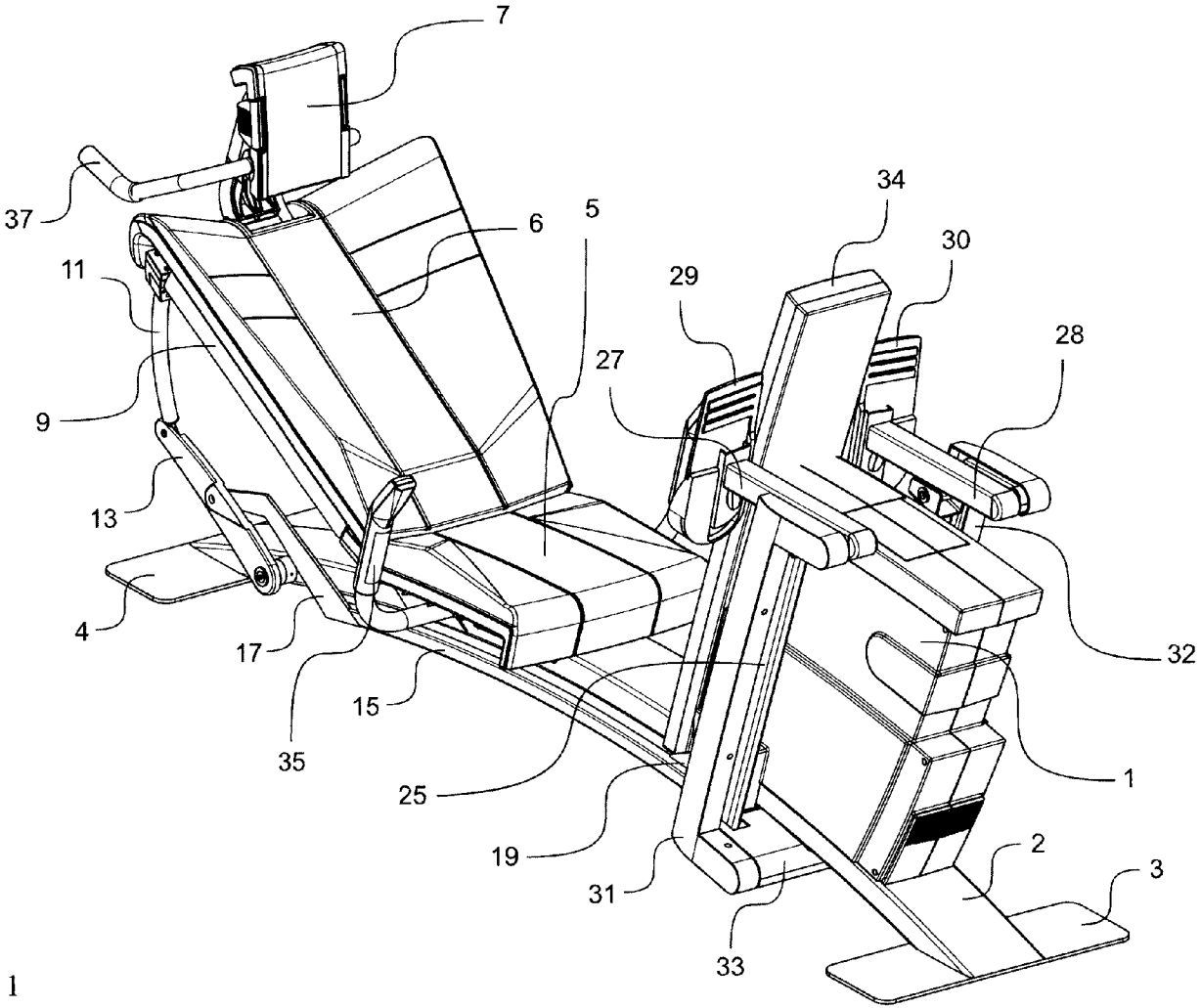
FIG. 1 is a front right perspective view of one embodiment of the exercise machine according to the present invention, with the contents of the mechanical and electronic systems box covered.
Figure 2:
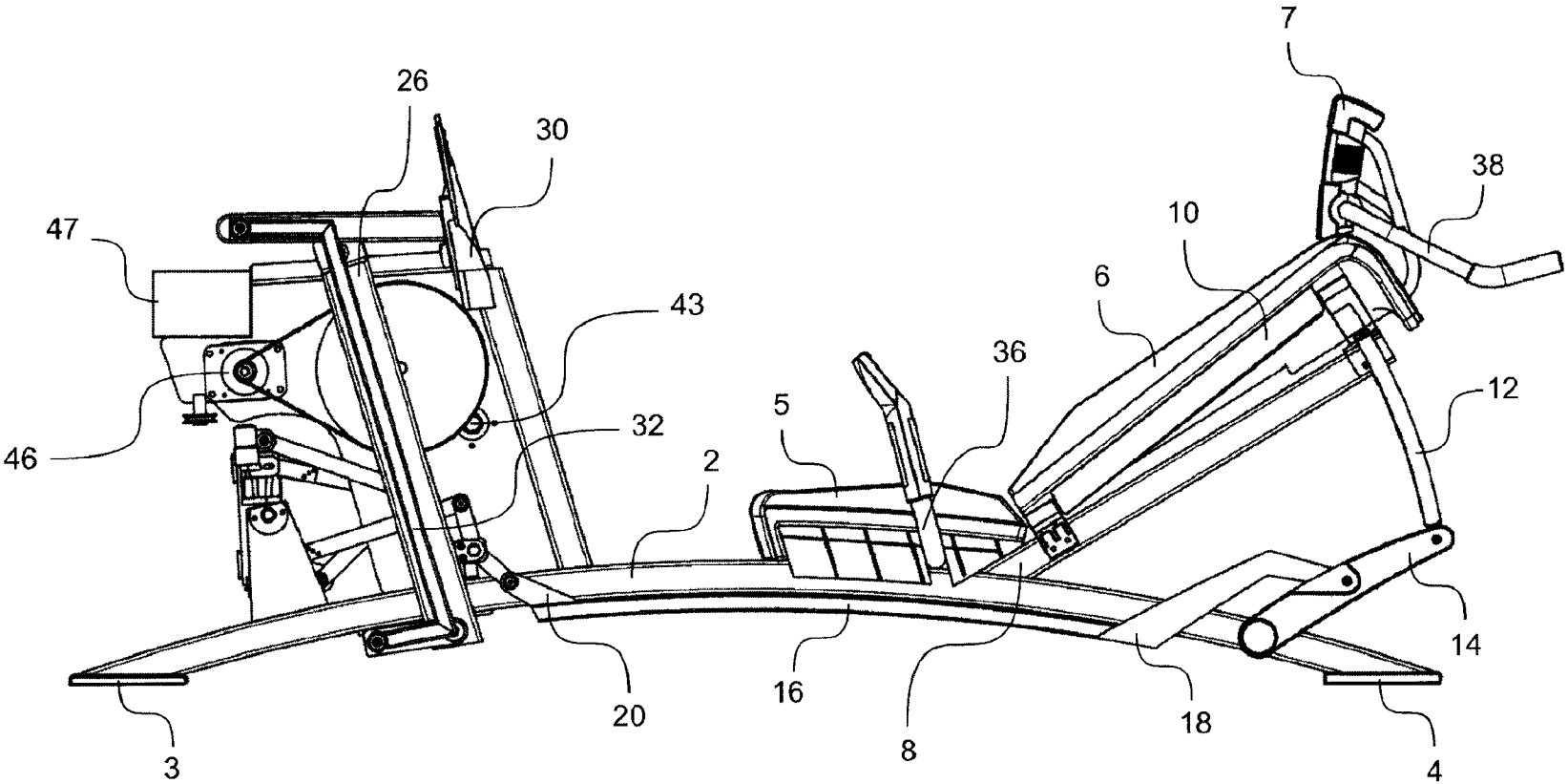
FIG. 2 is a left side view of one embodiment of the exercise machine according to the present invention with the mechanical and electronic systems box uncovered.
Figure 3:
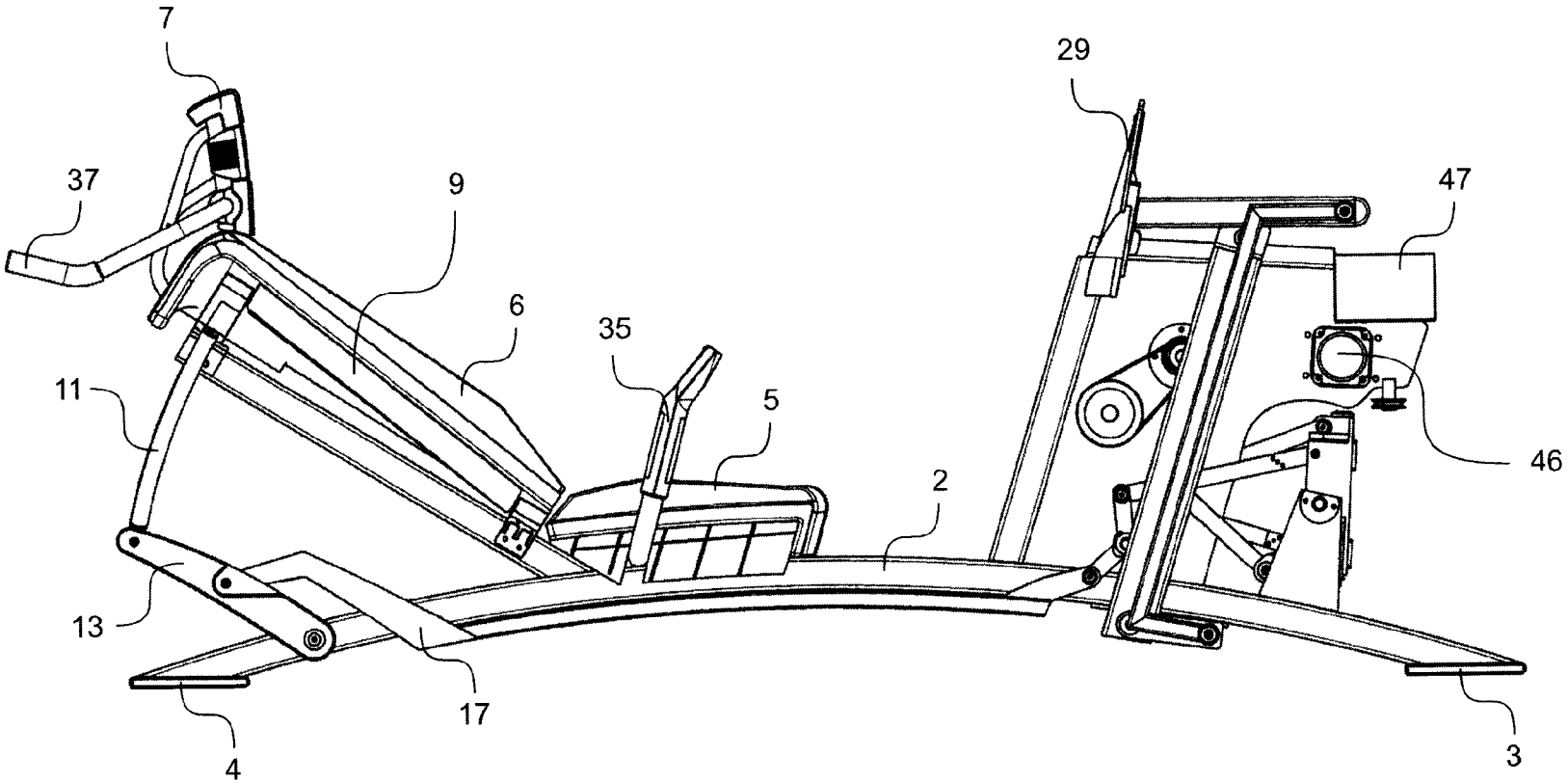
FIG. 3 is a right side view of one embodiment of the exercise machine according to the present invention with the mechanical and electronic systems box uncovered.

The rigid frame (2) that supports the user and the various machine components can present various shapes. In the example illustrated in FIG. 1 it has the shape of a single arched beam, with both ends of the arched beam rigidly connected to generally rectangular flat plates (3, 4) that distribute the load to the ground and ensure lateral stability. Viewed from above, the support frame's shape corresponds to that of a letter "I". Other embodiments of the rigid support frame are also contemplated. The illustrated embodiment however, of the shape and disposition previously described is a non-limiting example.

The rear portion of the rigid support frame (2) features a chair for the user, who sits facing the box (1) containing mechanical and electronic systems. The box (1) illustrated is no wider than the rigid support frame (2) itself and is rigidly attached to it. The box (1) may be of different widths so long as its weight is distributed in a manner relative to the support frame such that the box assists in stabilizing the machine.

The user's chair has three separate elements: a chair seat (5), a chair backrest (6) and a chair headrest (7). The chair seat (5) is attached to the rigid support frame (2). The chair backrest (6) is supported by a slanted beam (8) rigidly attached to the support frame (2). The chair headrest (7) is attached to the chair backrest (6) top frame.

Two lateral frame bars (9, 10) are positioned at the right and left edges of the chair backrest (6). Two pusher bars (11, 12) have their upper ends pivotally attached to the upper ends of the lateral frame bars (9, 10). The lower ends of the pusher bars (11, 12) are pivotally attached to the upper ends of pusher levers (13, 14). The pusher levers (13, 14) are pivotally attached to the rigid support frame (2) on its right and left sides, in the area close to the rear end of the support frame (2).

Two puller bars (15, 16) are positioned alongside the length of the support frame (2) on its right and left side. Each one of the puller bars (15, 16) features a rear puller bracket (17, 18) at its rear end and a front puller bracket (19, 20) at its front end. The upper end of the rear puller brackets (17, 18) is pivotally attached to a point positioned in the central area of the pusher levers (13, 14).

The upper end of the front puller brackets (19, 20) is pivotally attached to an arrangement of articulated piston rods and crankshafts that ultimately move the internal arms (21, 22). A pair of independent right and left bottom axles (23, 24) connects the lower ends of the internal arms (21, 22) to the lower ends of external arms (25, 26). Based on this disposition, the internal arms (21, 22) rotate together with the external arms (25, 26) in a solidary/sympathetic motion. Other dispositions are contemplated so long as the foot pedal movement can be synchronized with the backrest movement as described herein.

Each of the two external arms (25, 26) is pivotally connected at its upper end to a pedal shaft (27, 28). Each pedal shaft (27, 28) contains the base stem of a pedal (29, 30), forming a telescopic arrangement which allows the adjustment of the pedals (29, 30) by bringing them closer or further away from the user's body. Furthermore, the pedals surface can be slid vertically into several adjustment positions, positioning them closer or further away from the ground.

Two guide arms (31, 32) are to be found on either side of the mechanical and electronic systems box (1). The guide arms (31, 32) feature angled portions at both upper and lower ends, with both angled portions oriented towards the front end of the exercise machine. The upper end of each guide arm (31, 32) is pivotally attached to the rear end of a pedal shaft (27, 28), and the lower end of each guide arm (31, 32) is pivotally attached to a support bar (33) that is attached to the lower front end of the exercise machine.

Figure 4B:
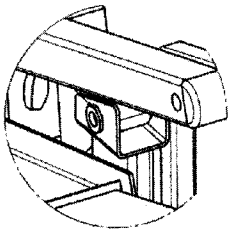
FIG. 4*b* shows the detail of the arm pedal pivot holder from FIG. 4.
Figure 4:
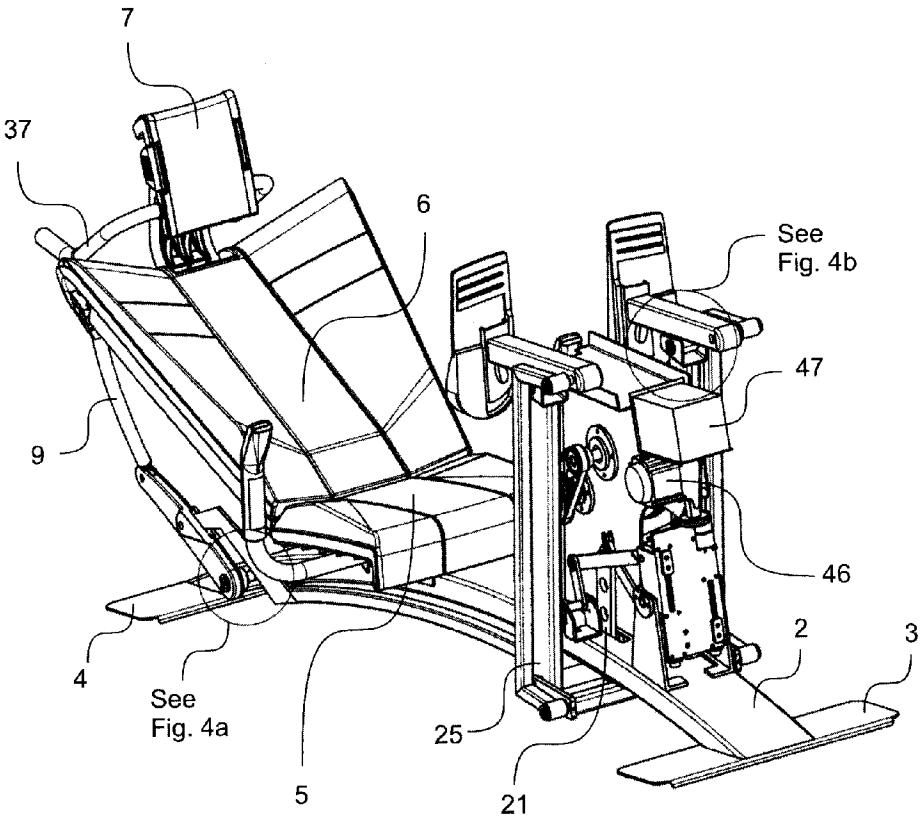
FIG. 4 is a front right perspective view of the exercise machine according to the present invention with the mechanical and electronic systems box uncovered and the instrument console removed.
Figure 4A:
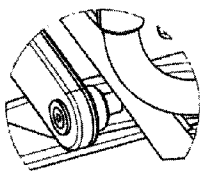
FIG. 4*a* shows the detail of the back pivot shaft from FIG. 4.
Figure 5A:
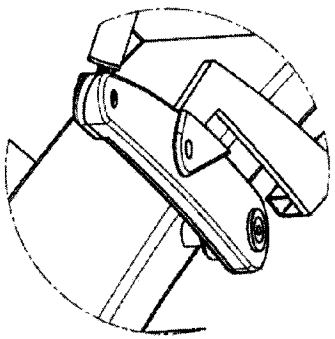
FIG. 5*a* shows the detail of the pusher bar connection from FIG. 5.
Figure 5:
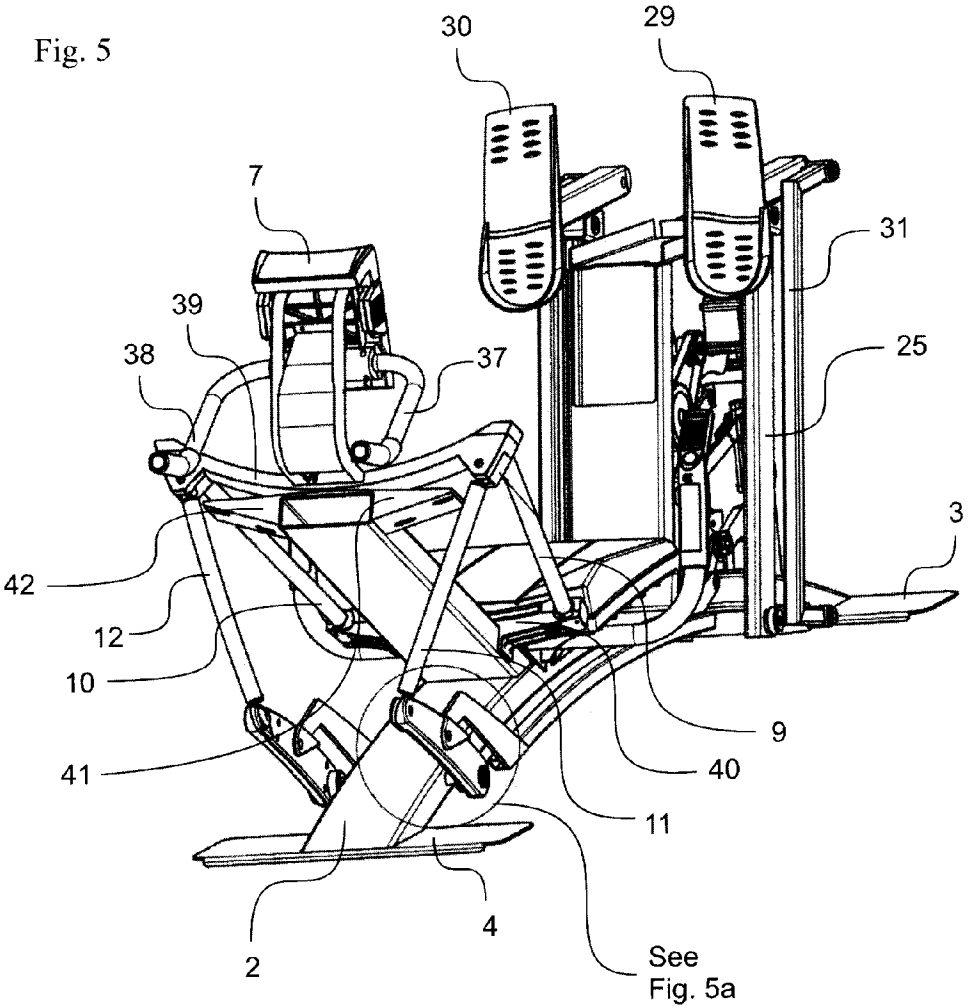
FIG. 5 is a rear right perspective view of the exercise machine according to the present invention with the mechanical and electronic systems box uncovered and the instrument console removed.
Figure 6:
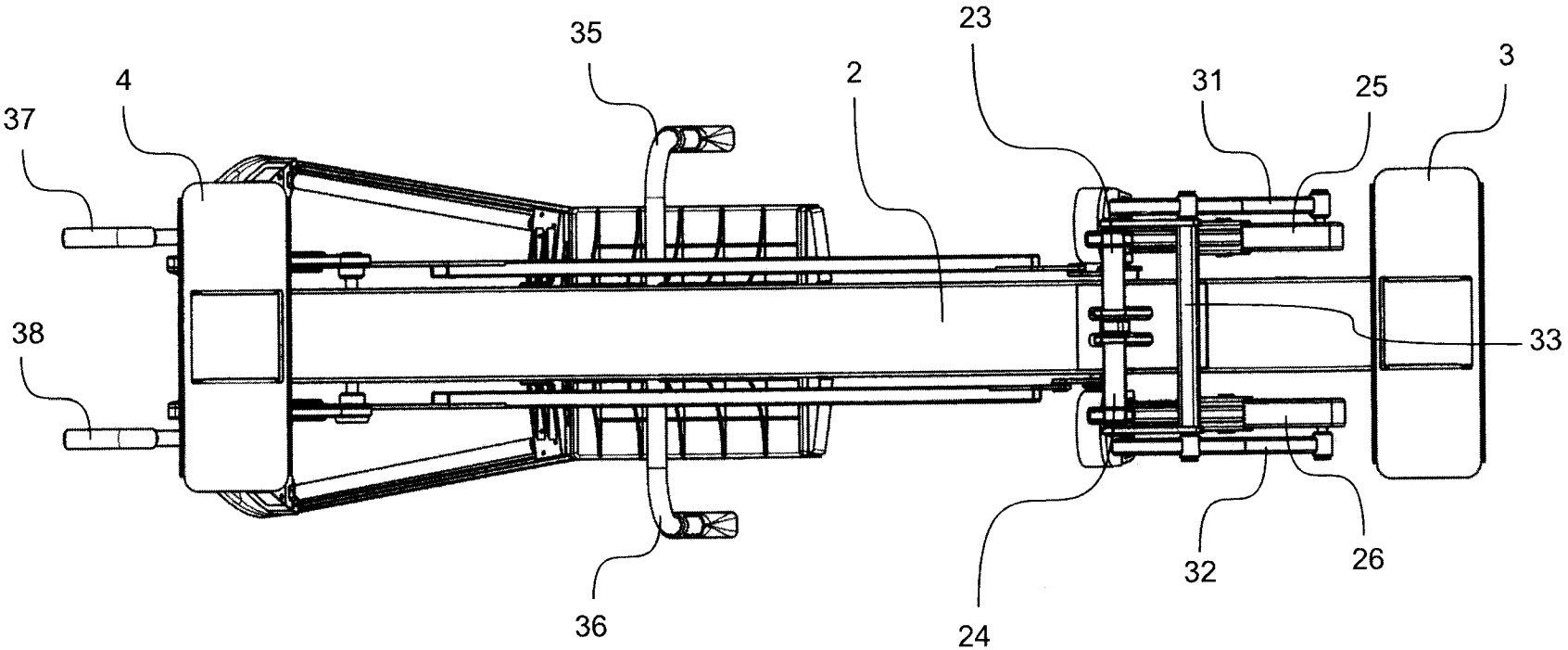
FIG. 6 is a bottom plan view of the exercise machine according to the present invention.
Figure 7A:
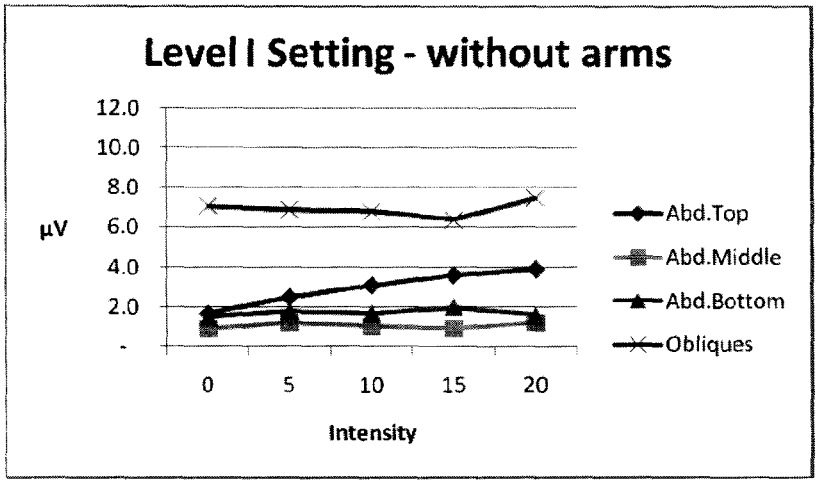
FIGS. 7 *a-c* show abdominal and oblique measurement test results of the exercise machine according to the present invention in which the user did not use the arms during the workout.
Figure 7B:
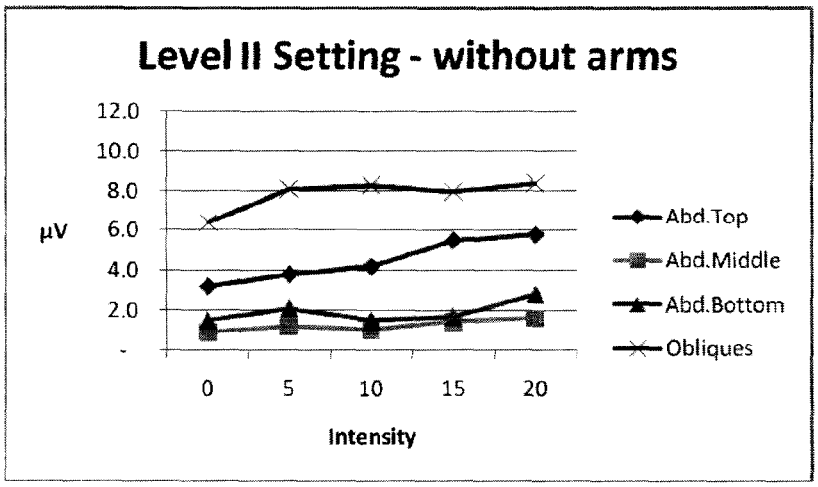
Figure 7C:
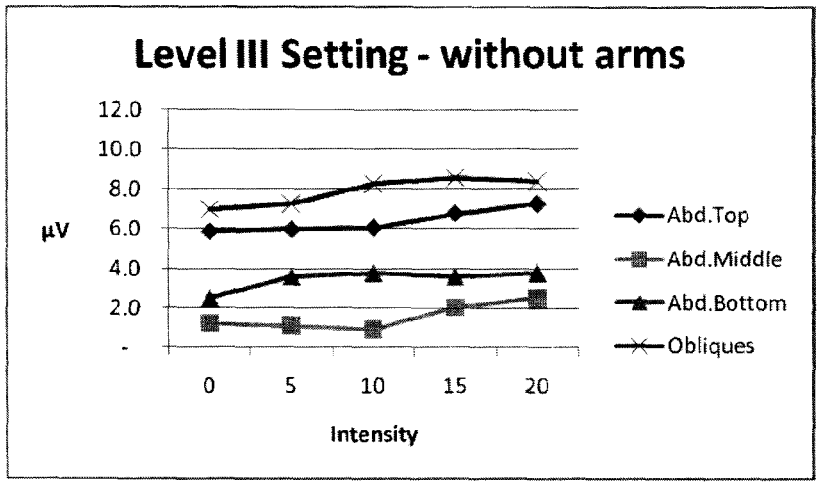
Figure 8A:
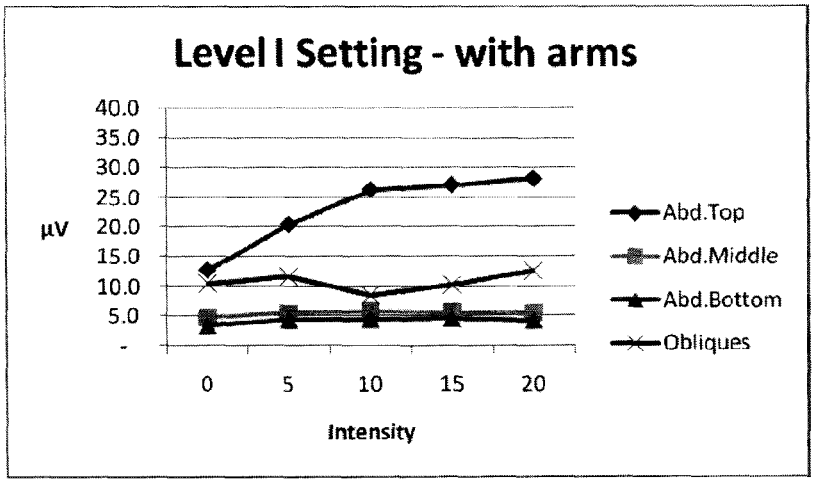
FIGS. 8 *a-c* show abdominal and oblique measurement test results of the exercise machine according to the present invention in which the user used the arms during the workout.
Figure 8B:
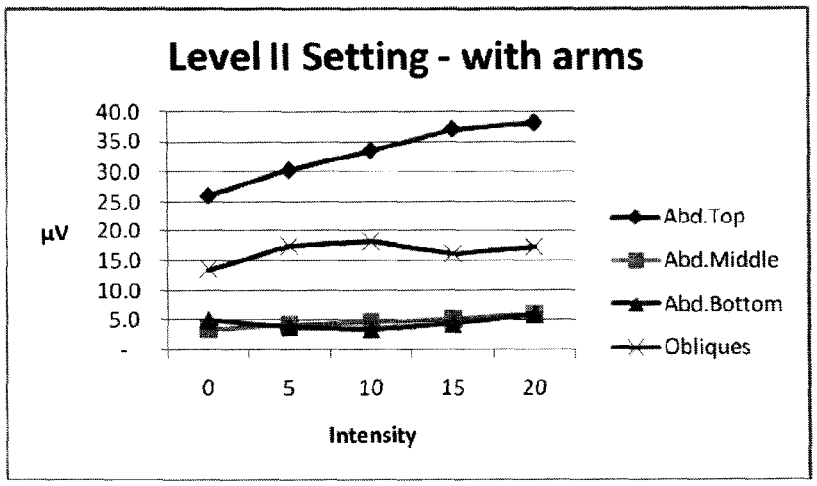
Figure 8C:
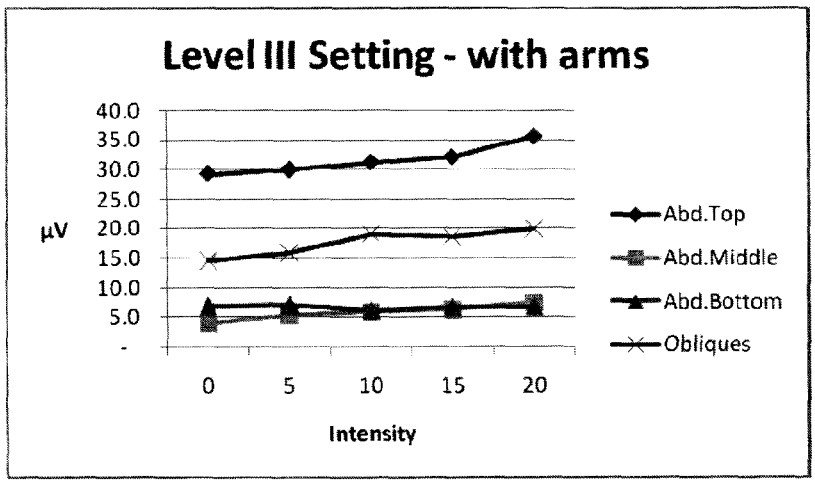

An instrument console (34) is positioned on the side of the mechanical and electronic systems box (1) that faces the user's body. For the purpose of illustrating various mechanical components of the invention, the instrument console (34) is not shown in FIGS. 4 and 5. There are two symmetric side handles (35, 36) positioned right and left of the chair seat (5) and attached to the machine's rigid support frame (2). The upper portion of the side handles (35, 36) features a range of controls for the various functions of the exercise machine. The lower portion of the side handles (35, 36) are positioned to offer the user a firm, convenient support, and can be held by the user's hands during the exercise routine. The user has the option of holding the headrest handles (37, 38) positioned right and left of the chair headrest (7). The headrest handles (37, 38) are pivotally attached to the sides of the headrest (7) and can be swung backwards to avoid obstructing the user's movements upon entering or leaving the machine. The figures illustrate the headrest handles (37, 38) in the back position. Once the user is seated and positioned in the machine, the headrest handles (37, 38) can be swung to a convenient position on either side of the user's head (not shown), so the user has the option of holding the handles (37, 38) with his or her hands for support during the workout.

In order to accommodate users with different body sizes in a comfortable and safe manner, the machine according to the present invention offers three different geometric adjustments. The distance between the chair headrest (7) and the top edge of the chair backrest (6) can be adjusted by sliding the chair headrest (7) to the desired position. The pedals (29, 30) can be slid vertically into several adjustment positions, positioning them closer or further away from the ground. Finally the pedals (29, 30) can be brought closer or further away from the user's body.

The proper adjustment of the headrest (7) is important, as the user is advised to rest his/her head on the headrest (7) while exercising in order to avoid unnecessary strain in the neck muscles.

When the user is positioned in the machine's chair with feet on the pedals (29, 30) and pushes one of the pedals towards the front end of the machine, the other pedal moves back towards the user's body. This movement is dictated by the machine's mechanics, with the pedals (29, 30) moving in a flat, reciprocal motion. The movement of the pedals is similar to that of a standard leg-press machine, except for the fact that the pedals move in a reciprocal pattern.

The movement of the pedals (29, 30) sets a series of other elements in motion. For the sake of simplicity, we describe the movement of the elements on the right side of the machine, pointing out that the exact same movements are carried out by the equivalent elements on the left side of the machine, only with a 180° phase difference in their cyclic movement: When the right pedal (29) moves forward towards the front end of the machine, it pushes the pedal shaft (27) forward. The pedal shaft (27) in turn pushes the upper end of the external arm (25) forward, making it pivot around the bottom right axle (23) and drag the front puller bracket (19) forward. This causes the puller bar (15) to move forward, imparting the forward movement to pusher lever (13) through the forward displacement of rear puller bracket (17). The pivot movement of pusher lever (13) displaces pusher bar (11) upwards, which in turn raises the upper end of the lateral frame bar (9).

When the right pedal (29) moves backwards towards the user's body, the movement imparted to all the other right-side elements described is exactly the same, only with its direction inverted. Therefore, the reciprocating movement of the pedals (29, 30) ultimately causes the alternate up and down movement of the upper ends of the lateral frame bars (9, 10), which in turn cause the rolling of the chair backrest (6). The range and speed of this movement is dictated by the movement of the pedals (29, 30), in a manner to be detailed further below.

The supporting structure of the chair backrest (6) is now described. The surface of the padded cushion of the chair backrest (6), which is the part that makes contact with the user's back, features a slightly concave shape that is designed to contribute to the stability of the user's torso during the workout. The chair backrest (6) has its edges framed by the lateral frame bars (9, 10), an upper backrest frame (39) and a lower backrest frame (40). The lower backrest frame (40) features a slightly concave shape and is rigidly attached to the lower portion of the slanted beam (8). The lower ends of the lateral frame bars (9, 10) are respectively attached to the right and left ends of the lower backrest frame (40) in a pivotal connection. The upper backrest frame (39) also features a slightly concave shape, and is respectively attached to the upper ends of the lateral frame bars (9, 10) in a pivotal connection. The upper backrest frame (39), however, is not rigidly attached to the machine's support structure: Its rear, convex-shaped face rests against the flat top surface made up by the upper portion of the slanted beam (8) and a pair of support tabs (41, 42) positioned right and left near the upper end of the slanted beam (8).

This arrangement causes the top right and left corners of the chair backrest (6) to raise and drop in phase with the movement of the pedals (29, 30). When the right pedal (29) moves forward and the left pedal (3) moves back, the top right corner of the chair backrest (6) raises and the top left corner of the chair backrest (6) drops. When the pedals movement is reversed, so is the movement of the chair backrest. The bottom corners of the chair backrest (6) never move, serving all the while as pivot points for the movement of the lateral frame bars (9, 10). This results in a rolling movement of the top edge of the chair backrest (6), while the bottom edge remains still. The top edge of the chair backrest (6) is continually supported, with its upper backrest frame (39) rolling against the flat surface provided by the upper portion of the slanted beam (8) and the right and left support tabs (41, 42). The chair headrest (7) is attached to the chair backrest (6) top frame and rolls with it. The same happens to the headrest handles (37, 38) positioned right and left of the chair headrest (7).

Aside from driving the rolling of the chair backrest (6), the movement of the pedals (29, 30) also drives the movement of a series of elements contained in the mechanical and electronic systems box (1). As described above, the movement of the pedals (29, 30) drives the movement of the pedal shafts (27, 28), which in turn drives the movement of the external arms (25, 26). The right external arm (25) is rigidly connected to the right bottom axle (23), which in turn is rigidly attached to the right internal rotating arm (21). In keeping with the symmetrical disposition, the left external arm (26) is rigidly connected to the left bottom axle (24), which in turn is rigidly attached to the left internal rotating arm (22). Although their rotation movements are independent from each other, both the right internal rotating arm (21) and the left internal rotating arm (22) are connected to the primary hub (43). The primary hub (43) features two external sprocket rings (44, 45) which rotation is driven by chains connected to the upper ends of the right and left internal rotating arms (21, 22). The rotation of the external sprocket rings (44, 45) is only transmitted to the primary hub (43) in one direction (clockwise for example), and whenever either one of the two sprocket rings (44, 45) rotates in the opposite direction (counter-clockwise in this example), it gets decoupled from the primary hub (43), turning idly until it resumes rotation in the original direction (clockwise in our example). This coupling between the sprocket rings (44, 45) and the primary hub (43) is similar to that of a ratchet wrench, where torque is imparted in one direction only, with decoupling occurring whenever the rotation direction is reversed.

The arrangement described in the previous paragraph determines unidirectional imparting of traction to the primary hub (43), which in the present invention is driven alternately by the movement of each of the two pedals (29, 30) during their reciprocating movement. The unidirectional imparting of traction means that the primary hub (43) is only spun by either the right or left pedal movement when the pedal in question is moving forward, away from the user's body. When either pedal is moving towards the user's body, its corresponding sprocket ring rotates idly. The user does not have to actively pull the pedal towards his or her body while the other foot is pushing the other pedal.

The primary hub (43) is connected to an array of pulleys and belts that ultimately drives an electric power generator (46), wired to a battery (47). The generator (46) converts a portion of the mechanical energy of the primary hub (43) spinning movement into electric power, which is stored in the battery (47).

Only a portion of the user's legs movement is mechanically transmitted to the chair backrest (6) to make it roll. The balance of the user's muscular effort is converted to electric energy which is stored in the battery (47) by known means.

The rolling of the chair backrest (6) is mechanically driven by the movement of the pedals (29, 30), but only a small portion of the mechanical energy applied by the user on the pedals is actually used for rolling the backrest (6). The remainder is converted into electric energy by the generator (46). Even if the electrical systems of the machine were not functioning, the rolling of the backrest would still continue in the same manner described above, given the mechanical connections. Considering the importance of the backrest rolling to prevent injury to the user's lower back, its independence with the electric systems is advantageous.

In one embodiment of the present invention, the user can adjust the proportion between the range of the leg movement and the rolling of the chair backrest (6). The amount of actual rolling of the backrest for every inch of displacement of the pedals is adjusted according to user settings. In one embodiment of the present invention, there are three settings. Tests on the degree of muscle contraction were conducted for each setting of this embodiment, further described below. In another embodiment, there are five settings which result in the rolling range being 20%, 40%, 60%, 80% and 100% of the maximum range of backrest rolling. The maximum range is set within a safe tolerance.

Regardless of the proportional setting chosen by the user, the reciprocating movement of the right pedal (29) is tracked by the right lateral frame bar (9), and the movement of the left pedal (30) is tracked by the left lateral frame bar (10). The continuous tracking results is another feature of the present invention: If the user decides to shorten the pedaling movement, making the pedal strokes shallower, the resulting rolling of the backrest is also smaller in range. Furthermore, if the user pedals faster, the backrest rolls faster. It is up to the user to choose how deep the pedal movement should be. The deeper the pedal movement, the wider the range of backrest rolling, for the same given user setting. The fact that the range and speed of the pedal movement is coordinated with the proportional rolling movement of the chair backrest imparts a natural feeling of balance to the user all through the workout period.

Another aspect of the present invention is the need to harmonize the different user's pedaling patterns and the generator's input characteristics. Different users use different speeds and force when pedaling, which translates into different rotational forces or torque regimes imparted to the generator. In order to adapt this mechanical input range to the input requirements of the generator, the pedal movement's speed and torque must be accordingly stepped up or down. This normalization of the mechanical input is performed through a known reduction drive train. When the user dials in the desired RPM for the exercise routine, the machine's electronic system calculates the necessary generator resistance and continually adjusts it so as to keep the pedal speed in RPM as steady as possible, regardless of possible variations in the user's input effort. If the user reduces the speed or force of the pedaling movement, the generator reduces the machine's resistance to the pedaling movement. If the user increases the speed or force of the pedaling movement, the generator increases the machine's resistance to the pedaling movement.

The adjustment of the machine's resistance to the pedaling movement, hereinafter denominated "load," is electromechanical in nature. Based on the user's setting of desired speed, the machine's electronic system adjusts the total electrical resistance physically deployed in the circuit of the electric power generator (46). A bank of resistors is used to control the amount of electric current that can be generated in the generator's circuit. According to the Lenz principles, this is perceived by the user as the amount of physical inertia to overcome upon pedaling.

The amount of electric power generated by the user's pedaling is normally sufficient to power the machine's electric power consuming elements, which include a power controller circuit, the resistive bank, the battery and other electronics that are for information display. This renders the machine according to the present invention self sufficient, eliminating the need for external electrical power sources. In one embodiment, the electrical system can be connected to a power source to run the electronics if the battery has little or no charge due to the machine's prolonged non-use. The output of the electric power generator (46) is used to power the machine's own systems, and any excess power can be used to charge the battery (47). If the power generated becomes very high then the electronics also condition the power flowing to the battery to protect it from being damaged.

A series of laboratory tests were performed on the machine in order to investigate the present invention's capability to provide an aerobic abdominal workout and to evaluate the degree of abdominal contraction. The tests provided an objective measure of the relationship between the machine's settings and the amount of aerobic muscular work, inferred by the level of contraction of the abdominal muscles.

The tests involved the use of Electromyography (EMG), which is a technique for evaluating and recording physiologic properties of muscles at rest and while contracting. EMG is performed using an instrument called an electromyograph, to produce a record called an electromyogram. An electromyograph detects the electrical potential generated by muscle cells when these cells contract, and also when the cells are at rest.

The electrical source is the muscle membrane potential of about −70 mV. Measured EMG potentials range between less than 50 μV and up to 20 to 30 mV, depending on the muscle under observation. Typical repetition rate of muscle unit firing is about 7-20 Hz, depending on the size of the muscle (eye muscles versus gluteal muscles), previous axonal damage and other factors.

The tests were performed using a fit adult male subject that exercised in the present invention's machine while having his abdominal muscle contractions monitored by an electromyograph. The muscular contraction was measured over 1-2 minute periods at resistance settings of 0, 5, 10, 15 and 20, with the subject's hands places on the two symmetric side handles (35, 36) and with the subject's hands places on the headrest handles (37, 38) in a pushing manner. The results are listed in FIGS. 7*a-c* and FIGS. 8*a-c*, respectively, based on one of three machine settings for an embodiment of the present invention.

As can be seen, the user's upper abdominals and obliques contracts during the workout. The degree of contraction is significantly higher when the user employs the hands on headrest handles (37, 38) and pushes the respective handle towards the opposite knee. The relatively small degree of contraction in the lower and middle abdominals shows that the user's pelvic tilt is in the correct position, thereby minimizing the possibility of injury to the lower back and hips.

In another series of tests, the same user conducted a workout on the machine at resistance level 15, machine setting 3, using the hands on headrest handles (37, 38) for a period of 15 minutes. The only way the user could sustain this type of abdominal workout for this prolonged period is if the abdominal muscles used oxygen. In other words, the user underwent an aerobic workout for the legs, back, shoulders, obliques and abdominal muscle groups, among other muscle groups.

Figure 9A:
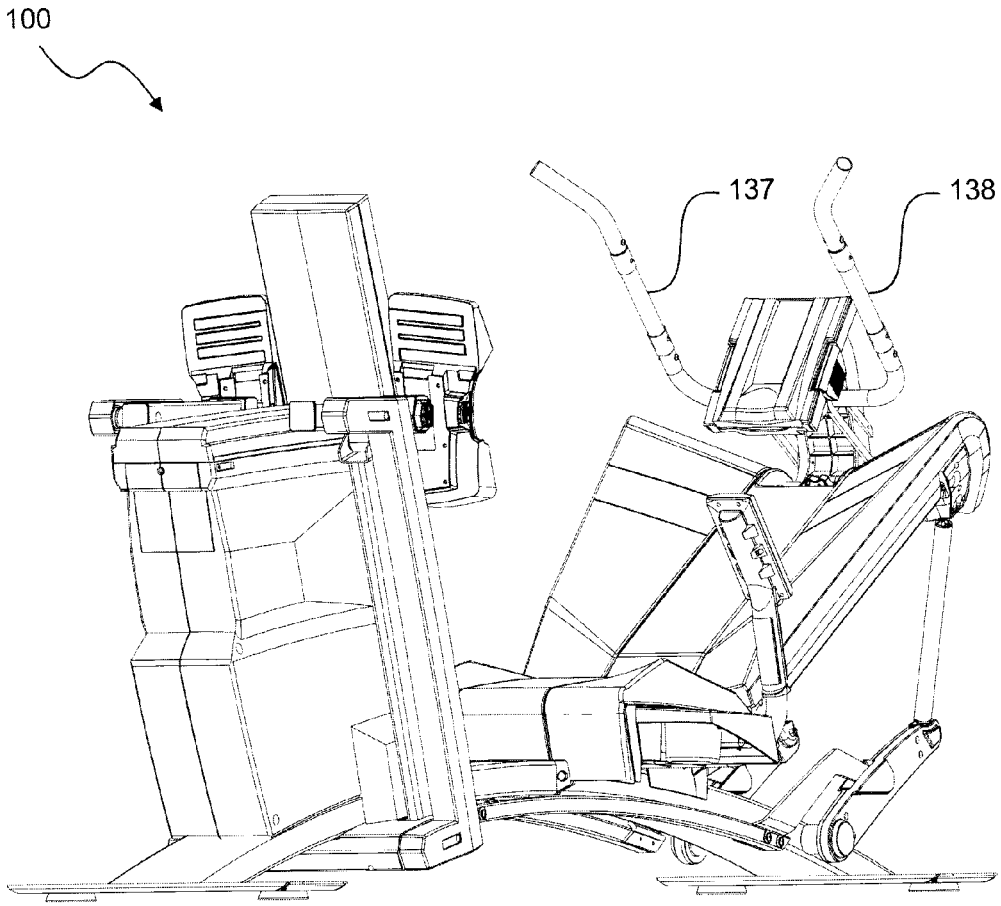
FIGS. 9 *a-c* show another embodiment of the exercise machine according to the present invention.
Figure 9B:
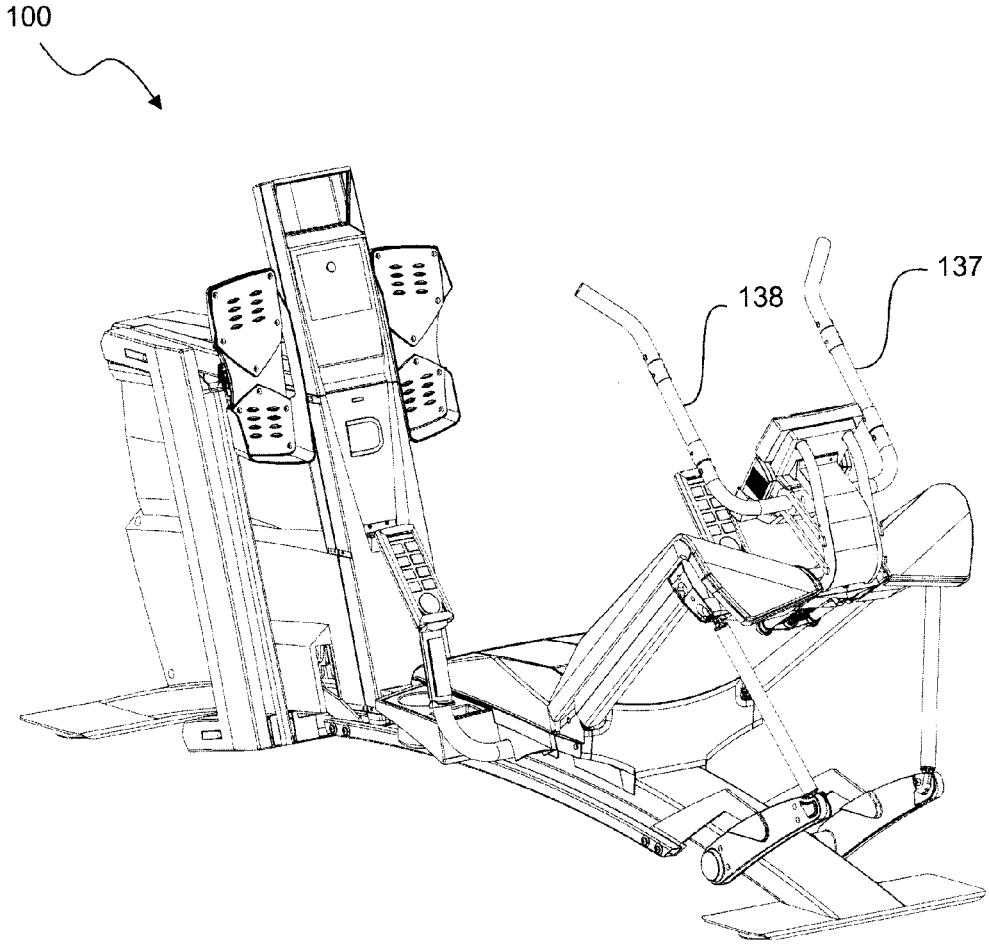
Figure 9C:
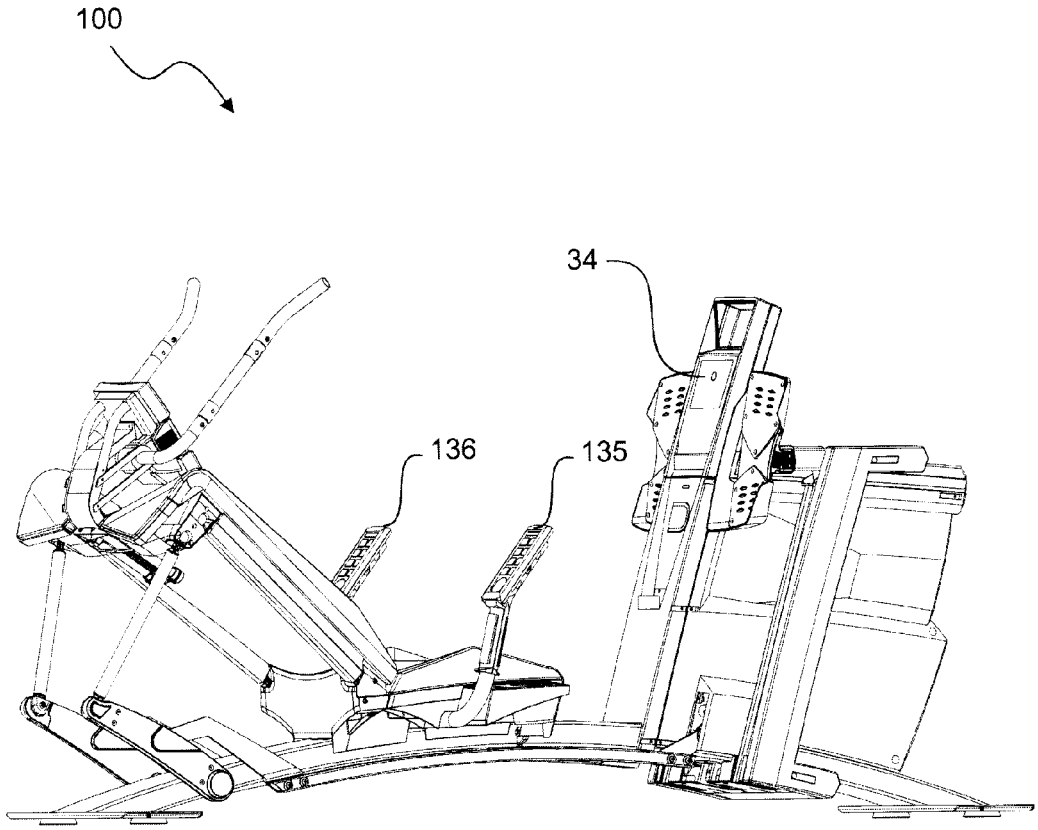

Another embodiment (100) of the present invention is shown in FIGS. 9*a-c*. This embodiment includes flexible, resilient and elongate handle members (137, 138), which bend under pressure allowing the user to extend his or her range of motion. The additional range of motion allows the user's upper abdominals and obliques to further contract during the workout. The flexible, resilient and elongate handle members (137, 138) are preferably comprised of nylon, although other materials with similar properties may be used. FIGS. 9*a-c* also shows an alternative chair configuration without slanted beam (8) and support tabs (41, 42), and an alternative instrument console (34) and side handle configuration.

As disclosed above, the rolling of the chair backrest (6) reduces the risk of lower back injury. In one embodiment of the present invention, the minimal setting the user can choose is 20% of the maximum rolling range. The backrest (6) must be centered and locked whenever the user is entering or leaving the machine, so as to ensure a clear path and proper support. In one embodiment, the machine features a built-in delay in its Start/Stop switch. When the user enters the machine, takes position and activates the Start switch, the rolling of the backrest increases gradually from zero to the setting the user has chosen. Once the Stop switch is activated, the backrest rolling is gradually reduced until it stops completely. In another embodiment, the range of backrest rolling can be electronically programmed into the exercise routine, with periods of no backrest rolling interposed between periods with backrest rolling.

Additional accessories may be used with the machine of the present invention to enhance the workout, such as rubber bands, chains or bars to be held by the user's hands. The purpose of the hand accessories is to increase the user's upper body movement, while maintaining the pelvic tilt position, in order to further increase the degree of workout.

The electronics system can power one or more entertainment and information display devices and controls, such as a DVD or other video device, LCD or other display screen, audio device. These devices may be located on the instrument console (34), which is positioned in the user's field of vision during the workout. Aside from a video screen, the panel of the instrument console (34) conveys exercise monitoring information such as cardio-vascular performance, exercise time, etc. Optionally one or more compact loudspeakers can be incorporated on either side of the chair headrest (7) to enhance the user's workout experience.

Figure 10:
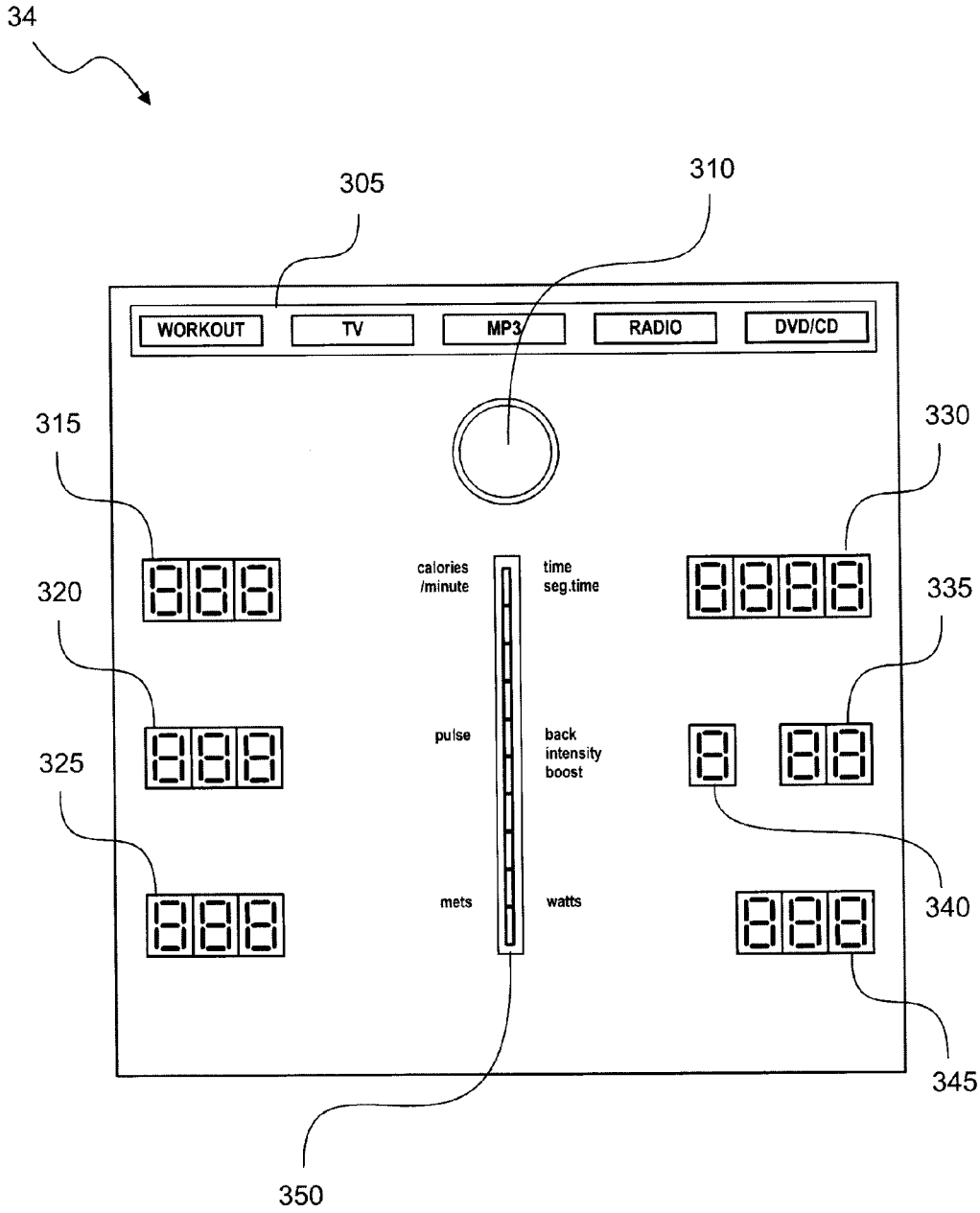
FIG. 10 shows and instrument console in accordance with an embodiment of the present invention.

Referring to FIG. 10, instrument console (34) is shown in accordance with an embodiment of the present invention. Instrument console (34) includes a top row of indicators (305) for displaying the current mode the machine is in, and a center button (310), which is used to turn the machine on and off. Optionally, center button (310) has a light ring around its perimeter which acts as an indicator. Instrument console (34) also includes top left LED display (315), which displays data alternating between calories and calories per minute, middle left LED display (320), which displays the user's heart rate when the user holds side handles (35, 36) for a given period of time such as 15 sec, bottom left LED display (325), which displays the METS (Metabolic Equivalent of Task) value during a workout program, top right LED display (330), which displays data during the workout alternating between the total workout time and segment time, middle right LED displays (335, 340), which displays the back position (1 to 5) and the resistance level (1 to 20), and bottom right LED display (345), which displays the generated power (instantaneous watts) generated by the user during the workout. Instrument console (34) further includes battery meter (350) which shows the current battery strength, providing the user with a visual indication of when the battery must be recharged by using the wall charger or operating the foot pedals as described above.

Figure 11A:
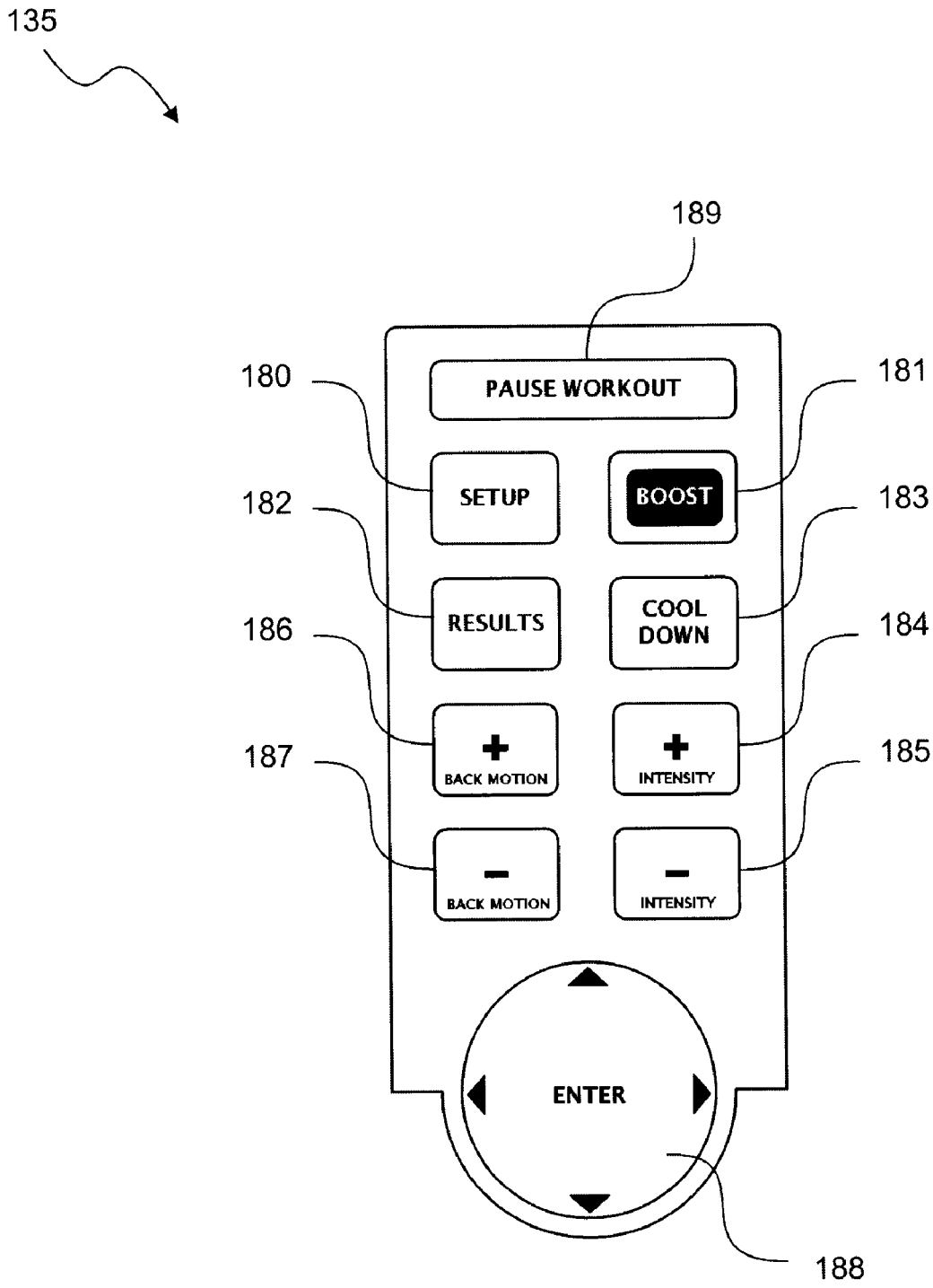
FIGS. 11 *a-b* show right and left control panels, respectively in accordance with an embodiment of the present invention.

Referring to FIG. 11*a*, right control pad (135) is shown in accordance with an embodiment of the present invention. Right control pad (135) includes a variety of switches or buttons that allow the user to control various aspects of the workout. Setup Button (180) permits the user to alternate between the Setup Screen, the Progress Screen and any entertainment mode that may be running on the machine. Boost button (181) when pressed increases the resistance level by a factor of two to three, depending upon the current resistance level. Pressing Boost Button (181) again will reduce the resistance level back to the previous resistance level. Optionally, an indicator LED is illuminated on instrument console (34) when the Boost Button (181) is pressed. Results Button (182) when pressed brings up a screen that provides an overview of the workout results. Cool Down Button (183) when pressed places the machine in a 'cool down mode' that gradually reduces the resistance level over a period of time such as two minutes followed by a machine shutdown. Intensity Buttons (184, 185) are used to adjust the resistance level. Back Motion Buttons (186, 187) is used to adjust the back motion level. Navigation Button (188) is used to navigate and select items on the LCD or other display screen. Pause Button (189) is used to pause the workout, and optionally to cancel the workout if pressed for a predetermined length of time.

Figure 11B:
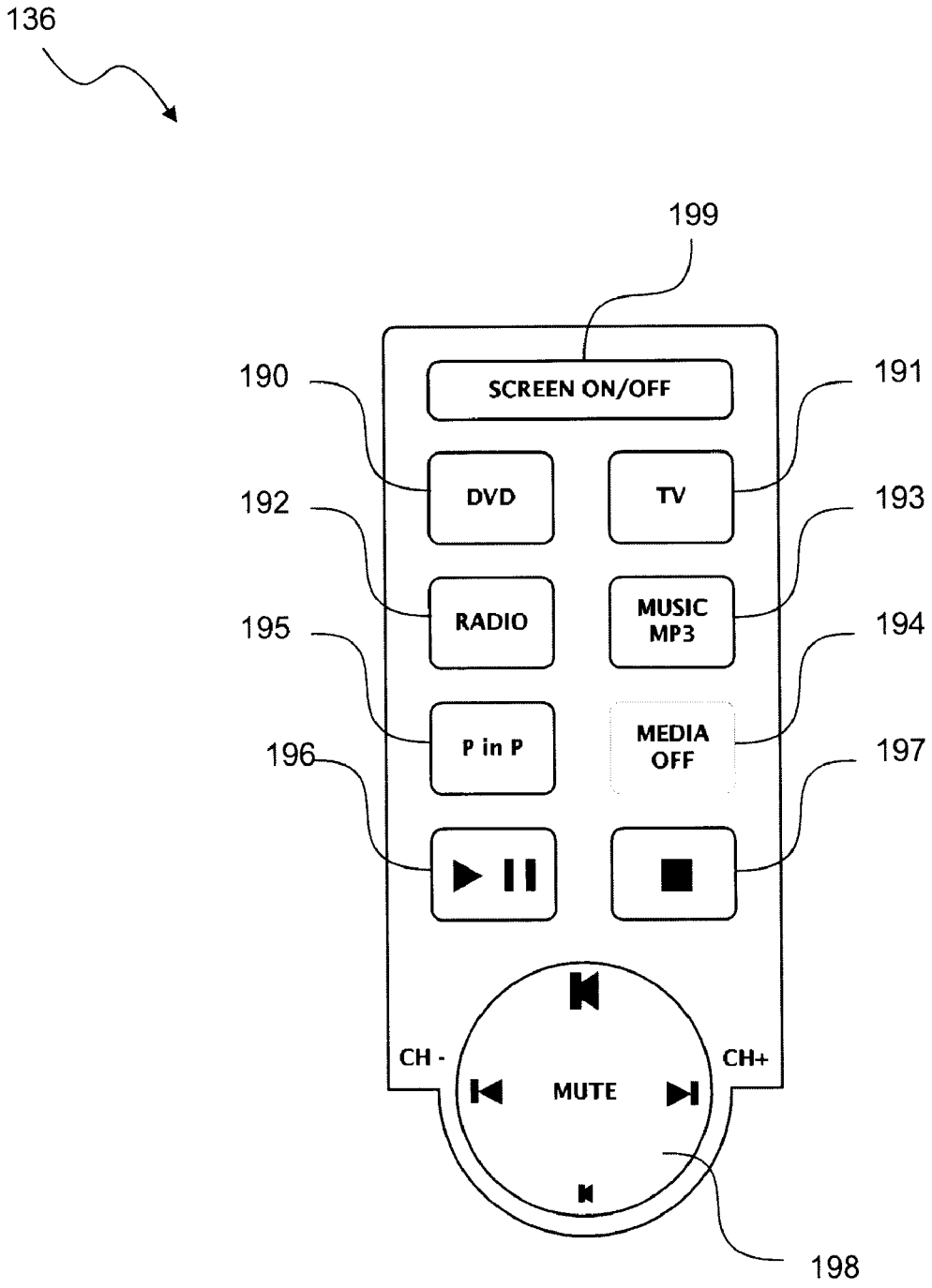

Referring to FIG. 11*b*, left control pad (136) is shown in accordance with an embodiment of the present invention. Left control pad (136) includes a variety of switches or buttons that allow the user to control the machine's entertainment system. DVD Button (190) when pressed enables the machine's DVD player. TV Button (191) when pressed switches the LCD display or other display to TV mode. However, a RF antenna, cable or other feed typically is required for this feature. Radio Button (192) when pressed switches the entertainment system to FM radio. Music/MP Button (193) when pressed switches the entertainment system to play an external music source connected to the machine through an AUX music port on the console. Media Off Button (194) when pressed will turn off the machine's entertainment system. P in P Button (195) when pressed will display a workout progress window within the entertainment mode window on the LCD display or other display. Play/Pause and Stop Buttons (196, 197) are used for their respective functions in the entertainment system. Circular Button (198) is used to play the previous or next song or channel, and to control the volume. Screen ON/OFF Button (199) is used to turn off the entertainment screen on the LCD or other display.

CONCLUSION

Many advantages achieved through the use of the present invention are related to the rolling of the backrest (6). This rolling of the backrest in phase with the movement of the legs, forces the body into a position that is both more comfortable and more secure regarding possible injury. With the user's spinal column being continually supported during the workout.

The machine provides an aerobic workout for the user of various muscle groups, including legs, back, shoulders, obliques and abdominal muscles.

The slightly concave shape of the chair backrest (6) contributes to stabilize the user's body in the pelvic tilt position, offering added support to the user's torso during the workout movements.

The rolling of the backrest (6), continually in phase with the leg movement, makes the foot movement much more comfortable and harmonic, thereby avoiding undue stress and making longer workout sessions more pleasant for the user.

The straight (as opposed to elliptical) movement of the pedals (29, 30) of the present invention provides the user freedom to decide how deep the pedaling movement should be at any moment. As the pedals trajectory is flat, it is the user's choice to decide how deep to pedal. The user may alternate between deep and shallow strokes without interfering with the continuous driving of the machine's electric power generator (46).

Another inherent advantage of the present invention is that the inertial resistance of the machine is very low due to the fact that the components displaced are compact and very light. Therefore, the inertia the user has to overcome upon starting to pedal (or restarting after a brief pause) is the negligible mass inertia and mechanical resistance of the generator itself. This is advantageous, because the low inertial resistance of the machine reduces the muscular strain required to initiate the pedaling movement. The profile of muscular effort is more regular and this aspect minimizes the risk of injury.

Although numerous characteristics and advantages of the present invention have been presented in the foregoing description, together with details of the structure and features of the invention, the disclosure is illustrative only. Those skilled in the art will appreciate the fact that the present invention is susceptible to modification including but not restricted to aspects such as shape, size and arrangement of parts without departing from the scope of fair meaning.

What is claimed:

1. An exercise machine comprising:

a rigid support frame;

a chair having right and left edges and a backrest; said chair coupled to said frame;

a pair of lateral frame bars positioned at the right and left edges of said chair;

a pair of foot pedals, each coupled to one of two pedal shafts;

said pedal shafts each being coupled to one of two external arms;

said external arms coupled to a puller bar;

said puller bar coupled to a pusher lever;

said pusher lever coupled to a pusher bar;

said pusher bar coupled to a lateral frame bar;

wherein movement of said foot pedals causes alternating up and down movement of said lateral frame bar and rolling of the chair backrest.

2. The exercise machine of claim 1, wherein said backrest comprises an upper and lower frame, generally concave in shape.

3. The exercise machine of claim 1, wherein said chair further comprises a headrest.

4. The exercise machine of claim 3, wherein said headrest comprises a pair of handle members, each pivotally attached to an opposing side of said headrest.

5. The exercise machine of claim 4, wherein said handle members are flexible, resilient, elongate, and adapted to extend the range of said rolling motion of chair backrest.

6. The exercise machine of claim 1, further comprising:

a box comprising mechanical and electronic systems; said box coupled to said frame, wherein said mechanical and electronic systems comprise an electric power generator coupled to a battery, said generator being adapted to convert a portion of the mechanical energy from movement of said foot pedals into electric energy.

7. The exercise machine of claim 6, wherein said mechanical and electronic systems further comprise an adaptor to releasably couple said electronic systems to an external electrical power source.

8. The exercise machine of claim 1, further comprising an instrument console, said instrument console having at least one indicator.

9. The exercise machine of claim 8, wherein said at least one indicator is adapted to provide visual indication of at least one of exercise machine mode, exercise machine operational status, and workout program data.

10. The exercise machine of claim 6, wherein said mechanical and electronic systems further comprise an entertainment display device having a display screen and entertainment device controls, said entertainment display device coupled to said box.

11. The exercise machine of claim 1, wherein the proportion between the rolling of said chair backrest and the movement of said pedals is adjustable to one or more pre-determined adjustment settings.

12. The exercise machine of claim 6, wherein said generator is coupled to a drive train adapted to step said pedal movement to the mechanical energy input requirements of said generator.

13. An exercise machine comprising:

a rigid support frame;

a chair having a backrest, the chair coupled to the upper surface of the frame; and a pair of foot pedals, wherein the pair of foot pedals is mechanically coupled to the chair backrest;

wherein movement of the foot pedals causes a lateral rolling movement of the upper portion of the chair backrest.

14. A method for exercising both the upper and lower body of a user, comprising the steps of:

a) providing an exercise machine according to claim 13;

b) positioning the user in the chair, the user's back supported by the backrest;

c) engaging the pair of foot pedals with the feet of the user; and d) producing movement of the foot pedals by alternate extension of the legs of the user;

whereby movement of the foot pedals results in the lateral rolling of the upper portion of the chair backrest.

15. The exercise machine of claim 13, wherein the lateral rolling movement causes upper right and left corners of the chair backrest to be moved in an alternate manner so that when one of the upper right and left corners of the chair backrest is raised, the other of the upper right and left corners is simultaneously lowered.

16. An exercise machine comprising:

a rigid support frame;

a chair having a backrest and a seat, the seat coupled to the upper surface of the frame, and the backrest extending outward from the seat in an incline position;

a left foot pedal and a right foot pedal, wherein the left foot pedal is mechanically coupled to a left portion of the backrest and the right foot pedal is mechanically coupled to a right portion of the backrest; and wherein extension of the left foot pedal raises the upper left portion of the backrest, and alternating extension of the right foot pedal raises the upper right portion of the backrest.

* * * * *